US011091308B2

(12) United States Patent
Nakamichi

(10) Patent No.: US 11,091,308 B2
(45) Date of Patent: Aug. 17, 2021

(54) CONTAINER

(71) Applicant: SAKAI DISPLAY PRODUCTS CORPORATION, Sakai (JP)

(72) Inventor: Kazuki Nakamichi, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/641,105

(22) PCT Filed: Sep. 7, 2017

(86) PCT No.: PCT/JP2017/032357
§ 371 (c)(1),
(2) Date: Feb. 21, 2020

(87) PCT Pub. No.: WO2019/049286
PCT Pub. Date: Mar. 14, 2019

(65) Prior Publication Data

US 2020/0189825 A1 Jun. 18, 2020

(51) Int. Cl.
*B65D 81/113* (2006.01)
*B65D 85/48* (2006.01)
*B65D 85/68* (2006.01)

(52) U.S. Cl.
CPC ..... *B65D 81/113* (2013.01); *B65D 85/48* (2013.01); *B65D 85/68* (2013.01); *B65D 2581/058* (2013.01); *B65D 2585/6837* (2013.01)

(58) Field of Classification Search
CPC ..... B65D 81/113; B65D 85/48; B65D 85/68; B65D 2581/058; B65D 2585/6837
(Continued)

(56) References Cited

U.S. PATENT DOCUMENTS 5,706,951 A * 1/1998 Oinuma ..... H01L 21/67366 206/592
7,543,706 B2 * 6/2009 Huang ..... B65D 5/5002 206/523

(Continued)

FOREIGN PATENT DOCUMENTS

JP S54-041862 U 3/1979
JP S59-064770 U 4/1984

(Continued)

OTHER PUBLICATIONS

International Search Report for International application No. PCT/JP2017/032357.

(Continued)

*Primary Examiner* — Jacob K Ackun
(74) *Attorney, Agent, or Firm* — ScienBiziP, P.C.

(57) ABSTRACT

A container (100) having: a housing member (10) having a bottom surface member (12) and a side surface member (14); and a protective member (20*a*) having a receiving surface in contact with an item to be housed. The bottom surface member defines the xy plane and the side surface member defines the xz plane and the yz plane that are orthogonal to the xy plane. The side surface member has a cut-out section (15*a*) that faces a housing space. The protective member has: an inside member (22*a*) comprising a receiving section (22R) having two receiving surfaces (23, 24) parallel to the xz plane and the yz plane; and an outside member (32*a*) arranged between the inside member and a side surface parallel to the yz plane of the side surface member, said outside member being fitted to the inside member so as to be slidable in a direction intersecting the bottom surface. The inside member and the outside member are arranged in the cut-out section so as to each be independently attachable and detachable. The inside member also comprises a support section (22S) formed in the y (Continued)

direction of the receiving section and having a support surface (22Sa) parallel to the xz plane. The support surface protrudes further in the x direction than the receiving surface parallel to the xz plane.

14 Claims, 8 Drawing Sheets

(58) Field of Classification Search
USPC ..... 206/592, 594
See application file for complete search history.

(56) References Cited

U.S. PATENT DOCUMENTS 8,215,484 B2 * 7/2012 Lim ..... B65D 81/058 206/320
2001/0030141 A1 * 10/2001 Kasakura ..... B65D 81/133 206/592
2013/0270139 A1 * 10/2013 Chen ..... B65D 81/107 206/453
2014/0202909 A1 * 7/2014 Kuo ..... B65D 11/10 206/453
2014/0262927 A1 9/2014 Guo et al.

FOREIGN PATENT DOCUMENTS

| | | | |
|---|---|---|---|
| JP | S61-164188 | U | 10/1986 |
| JP | S62-033147 | B2 | 7/1987 |
| JP | H05-054336 | U | 7/1993 |
| JP | 2013-151324 | A | 8/2013 |
| JP | 2014-009020 | A | 1/2014 |
| JP | 3192245 | U | 8/2014 |
| KR | 20-2014-0003413 | U | 6/2014 |

OTHER PUBLICATIONS

International Search Report for International application No. PCT/JP2017/018714.
Co-pending letter regarding related co-pending U.S. Appl. No. 16/606,624, filed Oct 18, 2019 et al.

* cited by examiner (a)

(b)

(a)

(b)

(a)

(b)

(a)

(b)

(a)

(b)

CONTAINER

TECHNICAL FIELD

The present invention relates a container, for example, a container preferably usable to transport an object accommodated therein.

BACKGROUND ART

For example, Patent Document No. 1 discloses a packaging member (i.e., container) usable to transport a display panel. The container disclosed in Patent Document No. 1 includes a corner protection member provided at a corner of a recessed portion that accommodates the display panel. The corner protection member is detachably fittable to a main body of the container and protects a corner of the display panel, which is an object to be accommodated. According to Patent Document No. 1, use of the corner protection member allows a common container main body and a common lid to be used regardless of whether a display panel having a circuit board connected therewith (hereinafter, may be referred to as a "display panel module") is to be accommodated or only a display panel is to be accommodated.

CITATION LIST

Patent Literature

Patent Document No. 1: Japanese Laid-Open Patent Publication No. 2014-9020

SUMMARY OF INVENTION

Technical Problem

However, in the case where the container described in Patent Document No. 1 is used, there are cases where during the removal of the display panel (or the display panel, module) from the container, the corner of the display panel is stuck with the corner protection member, and in some cases, the display panel is broken. Or, an attempt to prevent the breakage occasionally results in a decrease in the efficiency of the work of removing the display panel. For example, there is a problem that it is difficult to automatically remove the display panel by use of a robot (this may be referred to as "problem 1").

In the case where the container described in Patent Document No. 1 is used, if, for example, a large acceleration is applied during the transportation of the display panel, there are cases where a corner of the display panel is cracked. According to the studies made by the present inventor, this problem is caused because when a large acceleration (force) is applied to the corner protection member, the corner protection member rotates, as described below (this problem may be referred to as "problem 2").

In the above, the container accommodating the display panel is described. However, neither problem 1 nor problem 2 is limited to occurring in the case where the container accommodates a display panel, but may occur in the case where the container accommodates a rectangular plate-like object formed of a material that is easily cracked or chipped away (e.g., a glass plate or a plastic plate).

The present invention has an object of providing a container capable of suppressing breakage of an accommodated object, and suppressing a decrease in the working efficiency, during the removal of the accommodated object (solving problem 1) and/or capable of suppressing a corner of the accommodated object from being cracked or chipped away when a large acceleration is applied to the accommodated object (solving problem 2).

Solution to Problem

A container according to an embodiment of the present invention includes an accommodation member including a bottom surface member defining a bottom surface of an accommodation space having four corners and also including a side surface member defining side surfaces of the accommodation space, the bottom surface member defining an xy plane and the side surface member defining an xz plane and a yz plane both perpendicular to the zy plane; and two protection members each having two receiving surfaces that are to be in contact with an object to be accommodated in the accommodation space and are respectively parallel to the xz plane and the yz plane. The side surface member includes two cutout portions respectively facing two corners adjacent to each other among the four corners of the accommodation space. Each of the two protection members includes an inner member including a receiving portion having the two receiving surfaces and also includes an outer member located at least between the inner member and a side surface, of the side surface member, that is parallel to the yz plane, the outer member being fit to the inner member so as to be slidable in a certain direction crossing the bottom surface. The two protection members are respectively located in the two cutout portions in a state where the inner member and the outer member included in each of the two protection members are detachable in the certain direction independently. The inner member further includes a support portion formed adjacent to the receiving portion in a y direction and having a support surface parallel to the xz plane, and the support surface protrudes in an x direction more than the receiving surface parallel to the xz plane. Needless to say, the cutout portions may each toe provided at three or four corners, among the four corners, including the two corners adjacent to each other. The protection member may be provided at each of the two or more corners.

In an embodiment, the support surface of the inner member is contactable with a side surface, of the side surface member, that is parallel to the xz plane.

In an embodiment, the support surface of the inner member and a side surface, of the outer member, that is parallel to the xz plane are substantially flush with each other. In this state, the support surface of the inner member and the side surface, of the outer member, that is parallel to the xz plane may be in contact with the side surface, of the side surface member, that is parallel to the xz plane.

In an embodiment, the outer member is also located between the support surface and a side surface, of the side surface member, that is parallel to the xz plane.

In an embodiment, when the outer member is detached, the inner member falls toward a space where the outer member was present before being detached.

In an embodiment, the outer member is fit to the inner member so as to be slidable in a z direction.

In an embodiment, the inner member includes a plurality of ribs parallel to the xz plane, and the outer member includes a plurality of grooves parallel to the xz plane.

In an embodiment, the receiving portion of the inner member has a bottom surface in contact with the bottom surface member and parallel to the xy plane. A bottom surface, of the support portion, facing the bottom surface member and parallel to the xy plane Is not in contact with the bottom surface member.

In an embodiment, a length of the receiving portion in a z direction is longer than a length of the support portion in the z direction.

In an embodiment, the center of gravity of the inner member, is present outer to the bottom surface of the receiving portion as seen in a z direction.

In an embodiment, the inner member is formed of a non-expanded plastic material, and the outer member is formed of an expanded plastic material.

In an embodiment, the container further includes a protection sheet provided on each of the two receiving surfaces of the inner member, and the protection sheet is formed of a non-expanded plastic material harder than the material of the inner member.

In an embodiment, the accommodation member is formed of an expanded plastic material having a hardness equal to that of the expanded plastic material of the outer member or an expanded plastic material softer than the expanded plastic material of the outer member.

In an embodiment, the inner member and the outer member each have a plane of symmetry parallel to the xy plane.

Advantageous Effects of Invention

An embodiment of the present invention provides a container capable of suppressing breakage of an accommodated object, and suppressing a decrease in the working efficiency, during the removal of the accommodated object and/or capable of suppressing a corner of the accommodated object from being cracked or chipped away when a large acceleration is applied to the accommodated object.

BRIEF DESCRIPTION OF DRAWINGS

FIG. 7(*a*) is a schematic perspective view of an outer member 132*a*, and FIG. 7(*b*) is a schematic perspective view of the protection member 120*a* in a state where the inner member 22*a* is fit to the outer member 132*a*.

DESCRIPTION OF EMBODIMENTS

Figure 9:
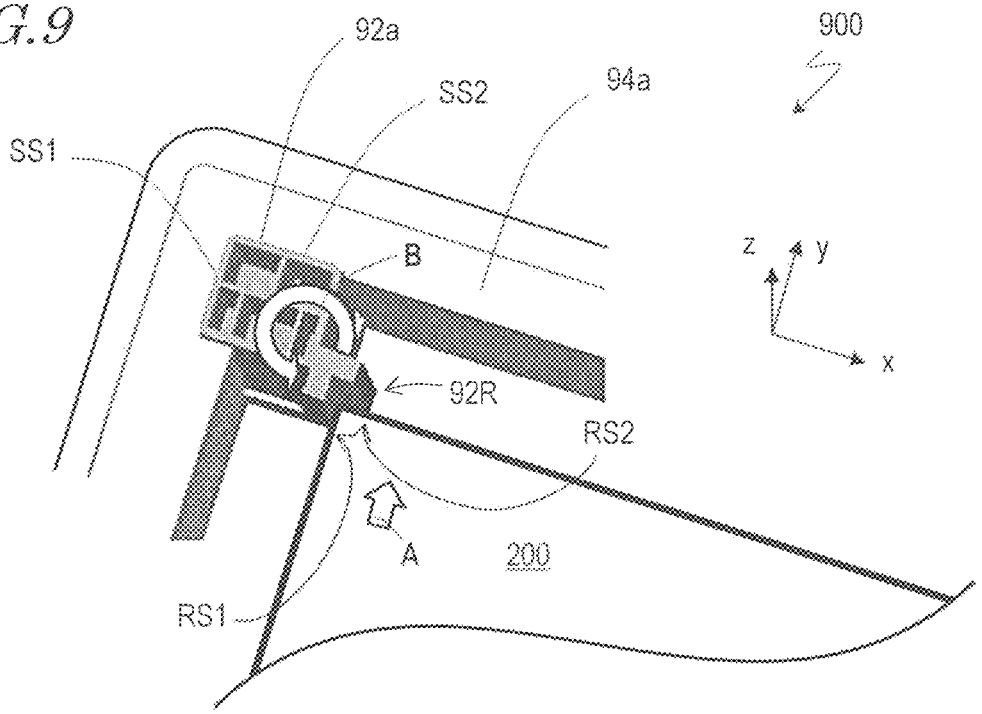
FIG. 9 is a schematic perspective view of a container 900 in a comparative example and is provided to describe problem 2 caused by a protection member 92*a*.

First, with reference to FIG. 9, problem 2 of the conventional container, including the corner protection member, described in Patent Document No. 1 will be described. FIG. 9 is a schematic perspective view of a container 900 including a protection member 92*a* having substantially the same structure as that of the corner protection member described in Patent Document No. 1.

The protection member 92*a* is integrally formed of a non-expanded resin. Two receiving surfaces RS1 and RS2 of a receiving portion 92R are in contact with a corner of a panel module 200, and thus the protection member 92*a* holds the panel, module 200 such that the panel module 200 does not move in an xy plane. The receiving surface RS1 is parallel to a yz plane, whereas the receiving surface RS2 is parallel to an xz plane.

When, for example, an acceleration is applied to the panel module 200 in a y direction as represented by arrow A as shown in FIG. 9, a force acts on the protection member 92*a* to rotate the protection member 92*a* counterclockwise as represented by arrow B. Since the receiving surface RS2 of the protection member 92*a* protrudes in an x direction more than a support surface SS2, the moment of force acting on the receiving surface RS2 so as to rotate the protection member 92*a* is large. Therefore, a side surface member 94*a* cannot stop the rotation of the protection member 92*a*, and the protection member 92*a* rotates. The side surface member 94*a* of the container 900 is formed of an expanded resin, and protection member 92*a* is formed of a material harder than that of the side surface member 94*a*. Therefore, the side surface member 94*a* may possibly be crushed by the protection member 92*a*. When the protection member 92*a* rotates, the panel module 200 cannot be held stably. This increases the frequency at which the panel module 200 is cracked or chipped away.

A container according to an embodiment of the present invention solves problem 1 that the accommodated object is broken, or the working efficiency is decreased, during the removal of the accommodated object and/or problem 2 that the corner of the accommodated object is cracked or chipped a way when a large acceleration is applied to the accommodated object.

Hereinafter, a container according to an embodiment of the present invention will be described with reference to the drawings. In the following, a container that accommodates a liquid crystal display panel module will be described as an example. An embodiment of the present invention is not limited to the following example. It should be noted that an embodiment of the present invention is directed to a container preferably usable to accommodate an object, like a liquid crystal display panel module, that cannot be supported by four sides but needs to be supported at corners and is formed of a material that is easily cracked ox chipped away (glass or a plastic material). An embodiment of the present invention is especially directed to a container preferably usable to transport a liquid crystal display panel module.

Figure 1:
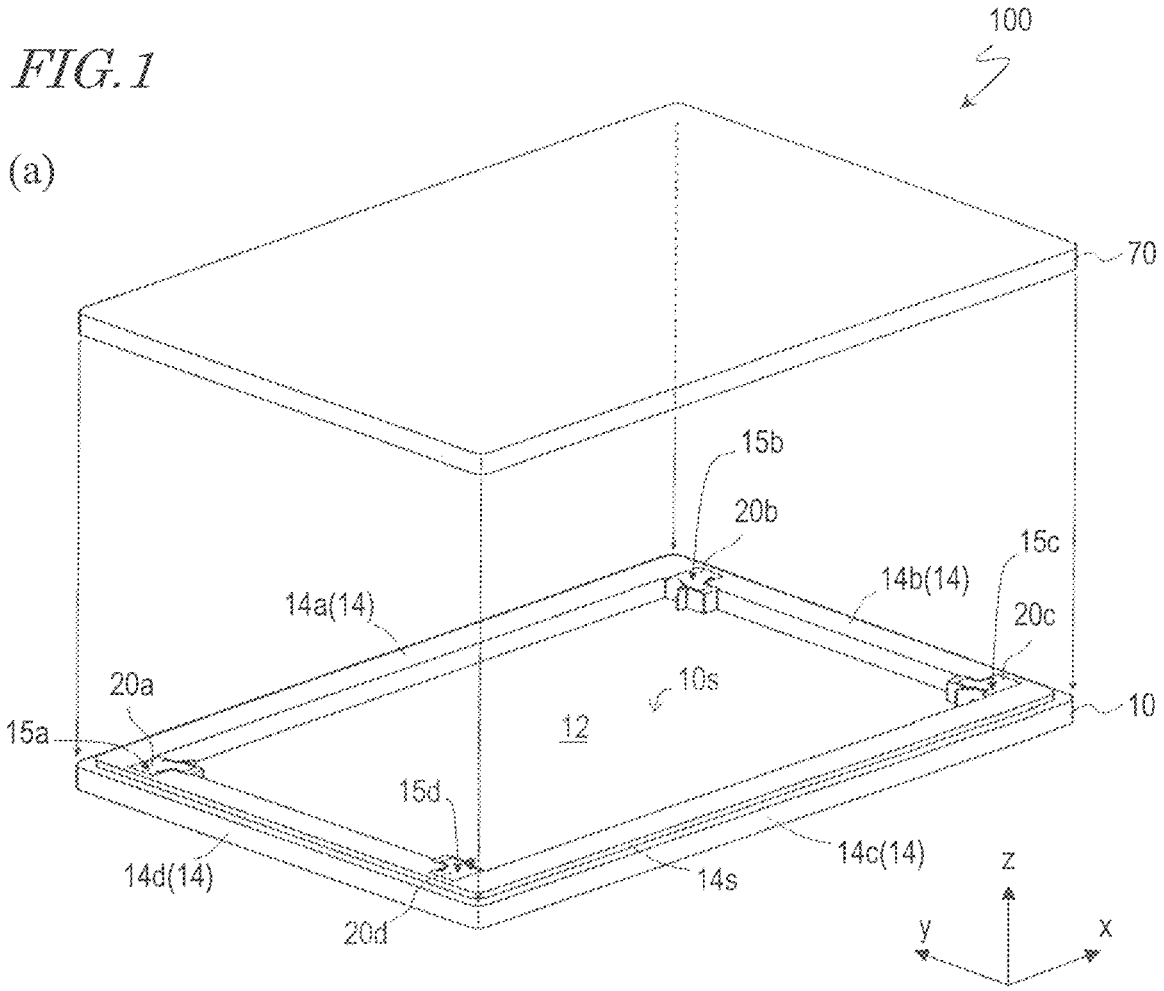
FIG. 1(*a*) is a schematic perspective view of a container 100 according to an embodiment of the present invention, and FIG. 1(*b*) is a schematic perspective view of a liquid crystal display panel module 200 to be accommodated in the container 100.
Figure 1:
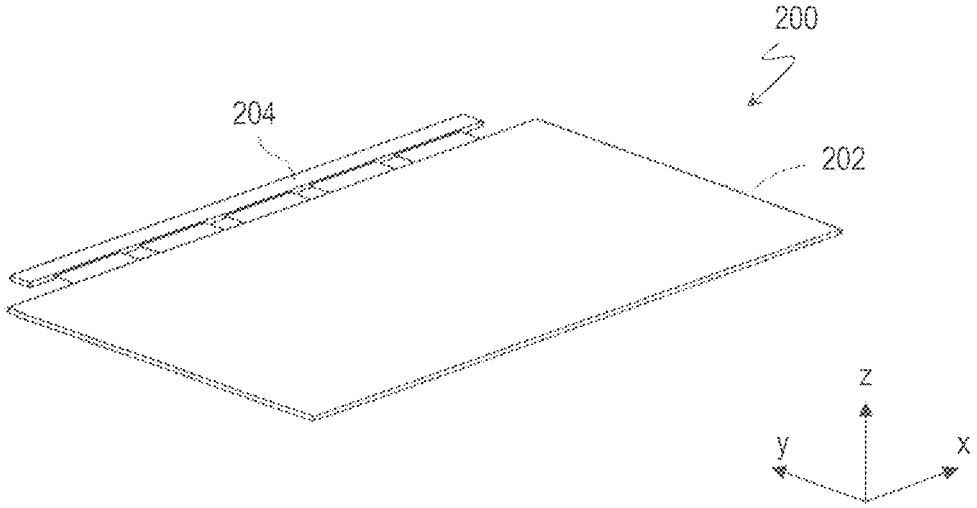

FIG. 1(*a*) is a schematic perspective view of a container 100 according to an embodiment of the present invention. FIG. 1(*b*) is a schematic perspective view of a liquid crystal display panel module (hereinafter, referred to as the "panel module") 200, which is to be accommodated in the container 100.

The container 100 includes an accommodation member 10 including a bottom surface member 12 defining a bottom surface of an accommodation space 10*s* and a side surface member 14 (14*a*, 14*b*, 14*c* and 14*d*) defining side surfaces of the accommodation space 10*s*, and also includes protection members 20*a*, 20*b*, 20*c* and 20*d* located in the accommodation space 10*s* and having receiving surfaces to be in contact with an object to be accommodated in the accommodation space 10*s*. The accommodation space 10*s* has four corners. The side surface member 14 includes cutout portions 15*a*, 15*b*, 15*c* and 15*d* respectively facing the four corners. The protection members 20*a*, 20*b*, 20*c* and 20*d* are respectively located in the cutout portions 15*a*, 15*b*, 15*c* and 15*d*. A lid 70 is optional and may be omitted. The bottom surface member 12 defines an xy plane, and the side surface member 14 defines an xz plane and a yz plane both perpendicular to the xy plane.

In this example, four protection members 20*a*, 20*b*, 20*c* and 20*d* are respectively located at the four corners of the accommodation space 10*s*. In the case where a circuit board 204 is mounted on only one side of a liquid crystal display panel (hereinafter, referred to as the "panel") 202, like in the case of the panel module 200, only the cutout portions 15*a* and 15*b* facing at least two adjacent corners, among the four corners, may be provided and the protection members 20*a* and 20*b* may be located only in the cutout portions 15*a* and 15*b*. Instead of the cutout portions 15*c* and 15*d*, a protection member that supports, for example, a side of the panel 202 may be located.

The panel module 200 is located in the accommodation space 10*s* of the container 100. A plurality of (e.g., 10 to 20) panel modules 200 may be located in a stacked manner. In this case, a cushioning sheet (e.g., expanded polyethylene (EPE) sheet; thickness: for example, 1 mm) may be held between the panel modules 200. It is preferred that the cushioning sheet is smaller by several millimeters to about 10 mm than an outer shape of the panel 202. Another container 100 may be stacked on the container 100 accommodating the panel module(s) 200. It is preferred that a bottom surface of the side surface member 14 of the container 100 has a stepped portion (not shown) engageable with a stepped portion 14*s* provided at a top surface of the side surface member 14. It is preferred that a bottom surface of the lid 70 has a stepped portion (not shown) engageable with the stepped portion 14*s* provided at the top surface of the side surface member 14.

Figure 2:
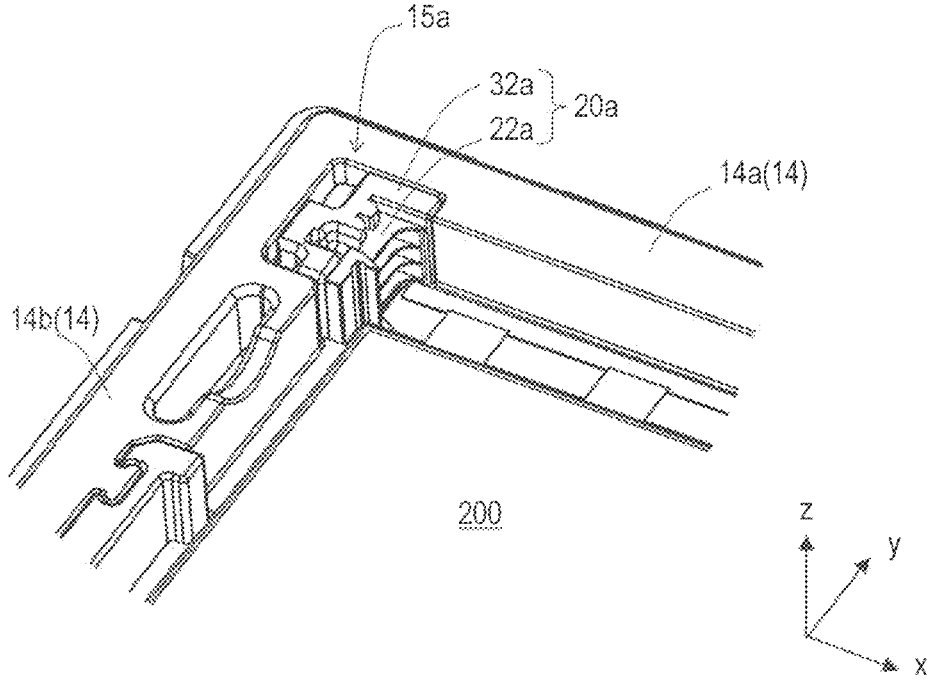
FIG. 2(*a*) is a schematic perspective view showing a state where a protection member 20*a* is attached to a cutout portion 15*a* of an accommodation member 10 of the container 100, and FIG. 2(*b*) is a schematic perspective view showing a state where an outer member 32*a* of the protection member 20*a* is detached.
Figure 2:
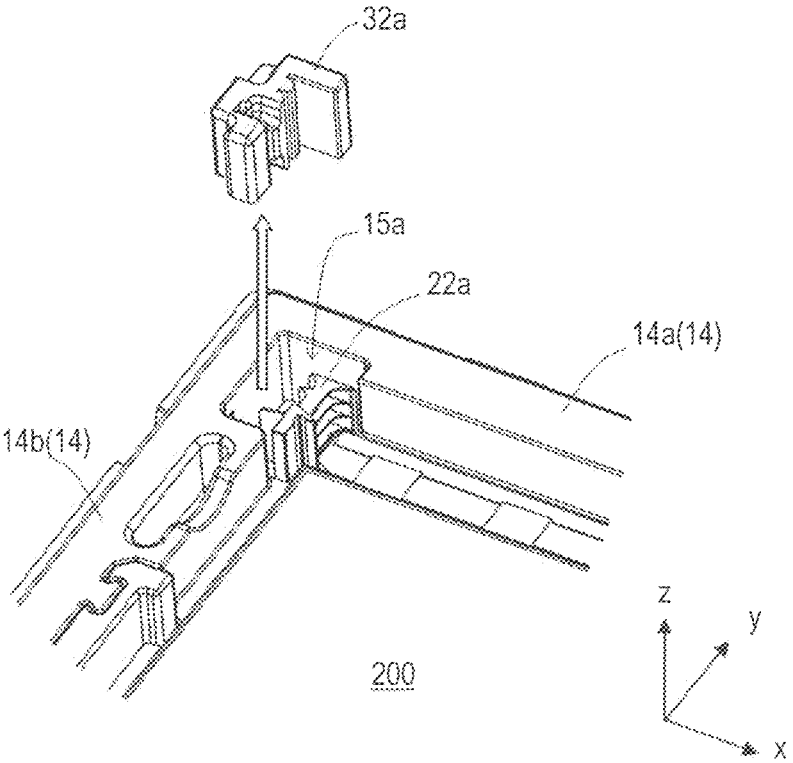

Now, FIG. 2 will be referred to FIG. 2(*a*) is a schematic perspective view showing a state where the protection member 20*a* is attached to the cutout portion 15*a* of the accommodation member 10 of the container 100. FIG. 2(*b*) is a schematic perspective view showing a state where an outer member 32*a* of the protection member 20*a* is detached. The protection members 20*b*, 20*c* and 20*d* each have an equivalent structure to that of the protection member 20*a*. Thus, the protection member 20*a* will be described as an example, hereinafter.

The protection member 20*a* includes an inner member 22*a* having receiving surfaces to be in contact with the panel module 200, and the outer member 32*a* located between the inner member 22*a* and the side surface member 14 (14*a* and 14*b*). The outer member 32*a* is fit to the inner member 22*a* so as to be slidable in a z direction. The inner member 22*a* and the outer member 32*a* are located in the cutout portion 15*a* while being detachable in the z direction independently. In this example, the outer member 32*a* is fit to the inner member 22*a* so as to be slidable in the z direction. The outer member 32*a* is not limited to being slidable in the z direction, and may be slidable any direction crossing the bottom surface.

The protection member 20*a* has a generally parallelepiped shape as a whole. The outer member 32*a* has side surfaces parallel to the xz plane and the yz plane (side surface 33*sb* and side surface 34*s* shown in FIG. 5(*a*)) and a top surface and a bottom surface both parallel to the xy plane. The outer member 32*a* is located in the cutout portion 15*a* such that the side surfaces of the outer member 32*a* that are parallel to the xz plane and the yz plane are in contact with side surfaces of the cutout portion 15*a* that are parallel to the xz plane and the yz plane.

The inner member 22*a* is fittable to the outer member 32*a*. While the inner member 22*a* is located in the cutout portion 15*a*, two receiving surfaces of the inner member 22*a* are parallel to the xz plane and the yz plane and are in contact with a corner of the panel module 200 (panel 202), and the inner member 22*a* holds the panel module 200 together with the inner members of the other three protection members 20*b*, 20*c* and 20*d* such that the panel module 200 does not move in the xy plane. As shown in FIG. 2(*b*), when the outer member 32*a* is slid in the z direction to be detached from the cutout portion 15*a*, a space into which at least a part of the inner member 22*a* may be retracted is formed in an area of the cutout portion 15*a* where the outer member 32*a* was present before being detached.

Figure 3:
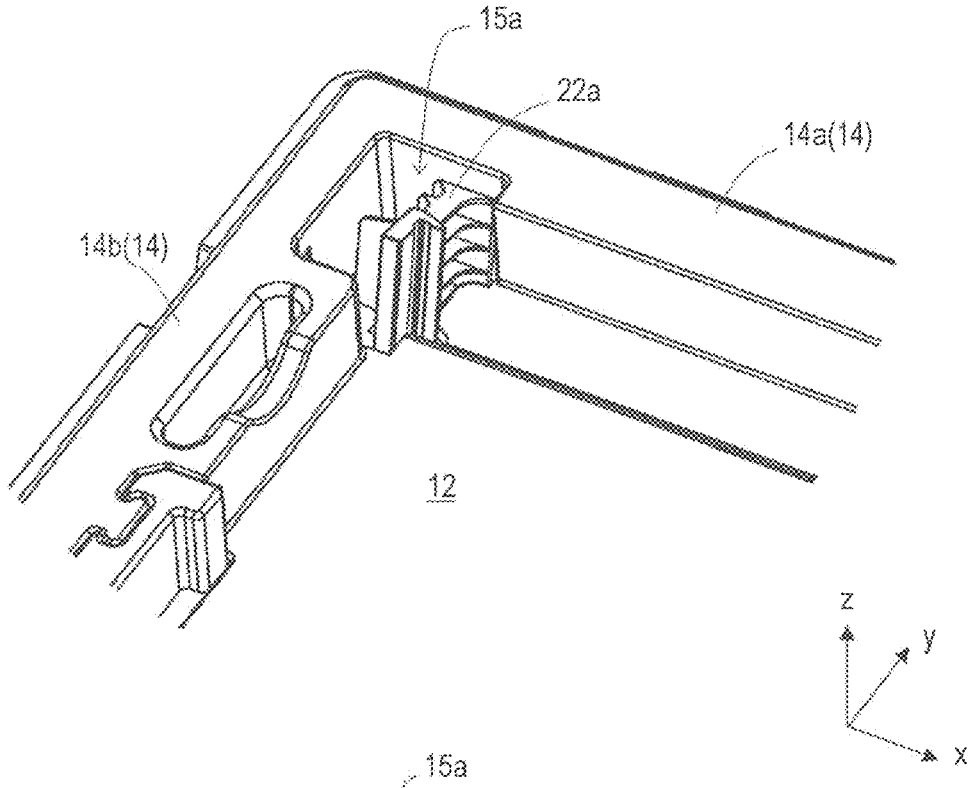
FIG. 3(*a*) is a schematic perspective view showing a state where an inner member 22*a* of the protection member 20*a* falls in a y direction, and FIG. 3(*b*) is a schematic perspective view showing a state where the inner member 22*a* of the protection member 20*a* falls in a −x direction.
Figure 3:
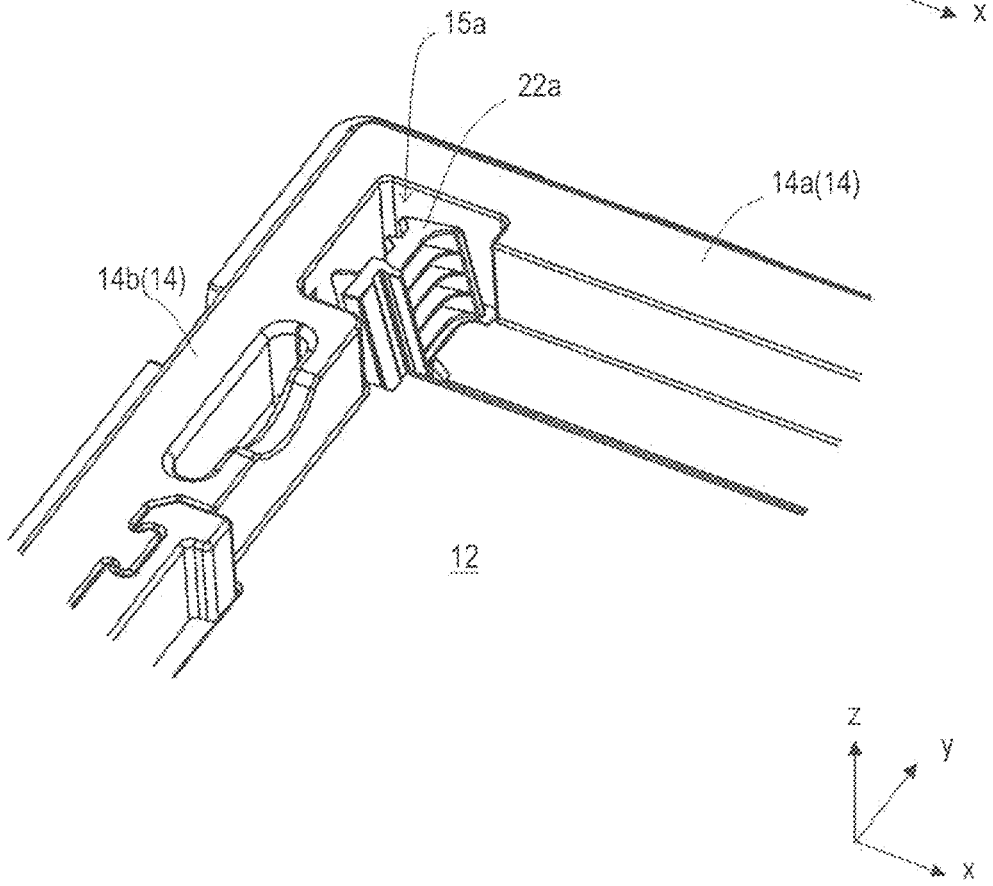

In the example described herein, as a structure that allows at least a part of the inner member 22*a* to be retracted into the space where the outer member 32*a* was present before being detached, a structure that when the outer member 32*a* is detached, allows the inner member 22*a* to fall toward the space where the outer member 32*a* was present before being detached is adopted. The inner member 22*a* in this example cannot stand itself in a state where the two receiving surfaces are parallel to the z direction, and fall in a direction away from the panel module 200. Therefore, the inner member 22*a* falls toward the space where the outer member 32*a* was present before being detached. The inner member 22*a* may be set to fall in the y direction as shown in FIG. 3(*a*) or may be set to fall in a −x direction as shown in FIG. 3(*b*). Needless to say, the inner member 22*a* may be set to fall either in the −x direction or in the y direction.

It should be noted that even if the container 100 does not include the structure shown here as an example, more specifically, the structure that when the outer member 32*a* is detached, allows the inner member 22*a* to fall toward the space where the outer member 32*a* was present before being detached, at least the effect that, as described below, a corner of the accommodated object is suppressed from being cracked or chipped away is provided.

Referring to FIG. 3(*a*) and FIG. 3(*b*), a recessed portion or the like formed in the side surface member 14 (14*b*) is provided in order to decrease the weight of the side surface member 14 and/or the amount of the material of the side surface member 14. Such a technique is well known in the field of plastic processing, and thus will not be described herein.

When the inner member 22*a* falls in a direction away from the panel module 200 as described above, a sufficiently large gap is formed between the panel module 200 and the inner member 22*a*. Therefore, during the removal of the panel module 200 from the accommodation space 10*s*, the corner of the panel module 200 (panel 202) is suppressed from contacting the inner member 22*a*. In addition, there is no component that supports the inner member 22*a*. Therefore, even if the inner member 22*a* does not fall in a direction away from the panel module 200 for some reason and as a result, the panel module 200 contacts the inner member 22*a*, no force that may break the panel module 200 is applied to the panel module 200. With such a structure, during the removal of the panel module 200, the problem does not occur that the panel module 200 is broken as a result of contacting the inner member 22*a*, or that the working efficiency is decreased by an attempt to prevent the breakage. For example, a robot may be used to automatically remove the panel module 200 from the container 100.

In a state where the protection member 20*a* is attached to the cutout portion 15*a*, it is preferred that the clearance between the above-described side surfaces of the outer member 32*a* and the above-described side surfaces of the cutout portion 15*a* is small. For example, the side surfaces of the outer member 32*a* and the side surfaces of the cutout portion 15*a* may be in contact with each other as long as the outer member 32*a* is easily detached from the cutout portion 15*a* while being nipped by a hand of a user. The clearance between one of the receiving surfaces of the inner member 22*a* and the panel module 200 is, for example, about 1 mm to about 3 mm in the case where, for example, the panel module 200 is of a 60-inch type. The clearances may be set to be small as described above, so that the panel module 200 is suppressed from moving in a plane parallel to the xy plane while being transported.

In addition, the protection member 20*a* includes the inner member 22*a* and the outer member 32*a* separable from each other. Therefore, even if, for example, a large acceleration is caused to the panel module 200 in the xy plane by sudden braking or the like during the transportation and as a result, a large impact, is applied to the receiving surfaces, the protection, member 20*a* exhibits a larger effect of absorbing the impact than the protection member 92*a* in the comparative example, which is of a single component. This contributes to the effect described below that a corner of the accommodated object is suppressed from cracked or chipped away.

Figure 4:
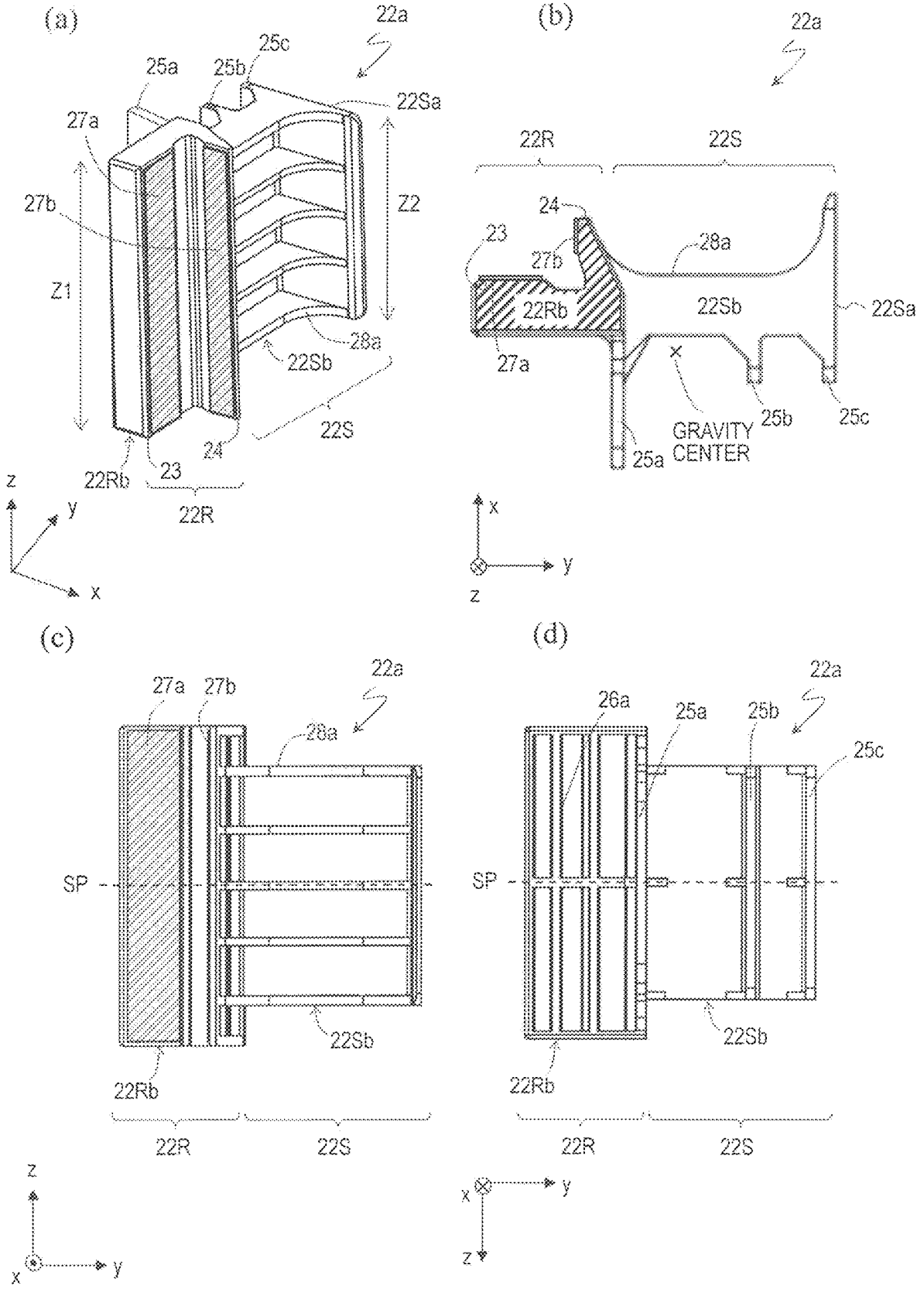
FIG. 4(*a*) is a schematic perspective view of the inner member 22*a*, FIG. 4(*b*) is a schematic plan view of the inner member 22*a* as seen in a z direction, FIG. 4(*c*) is a schematic plan view of the inner member 22*a* as seen the −x direction, and FIG. 4(*d*) is a schematic plan view of the inner member 22*a* as seen an x direction.
Figure 5:
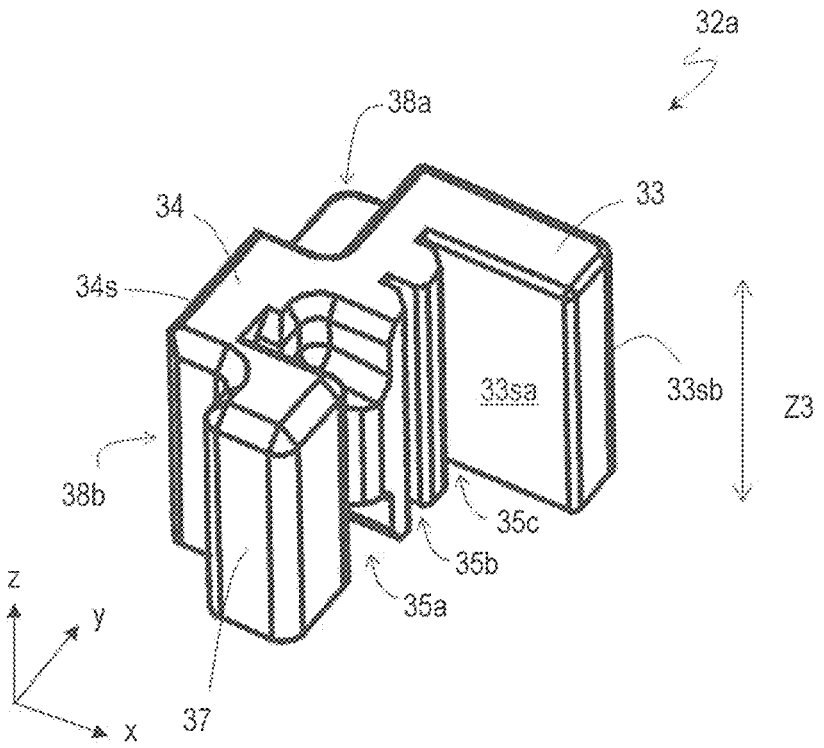
FIG. 5(*a*) is a schematic perspective view of the outer member 32*a*, and FIG. 5(*b*) is a schematic perspective view of the protection member 20*a* in a state where the inner member 22*a* is fit to the outer member 32*a*.
Figure 5:
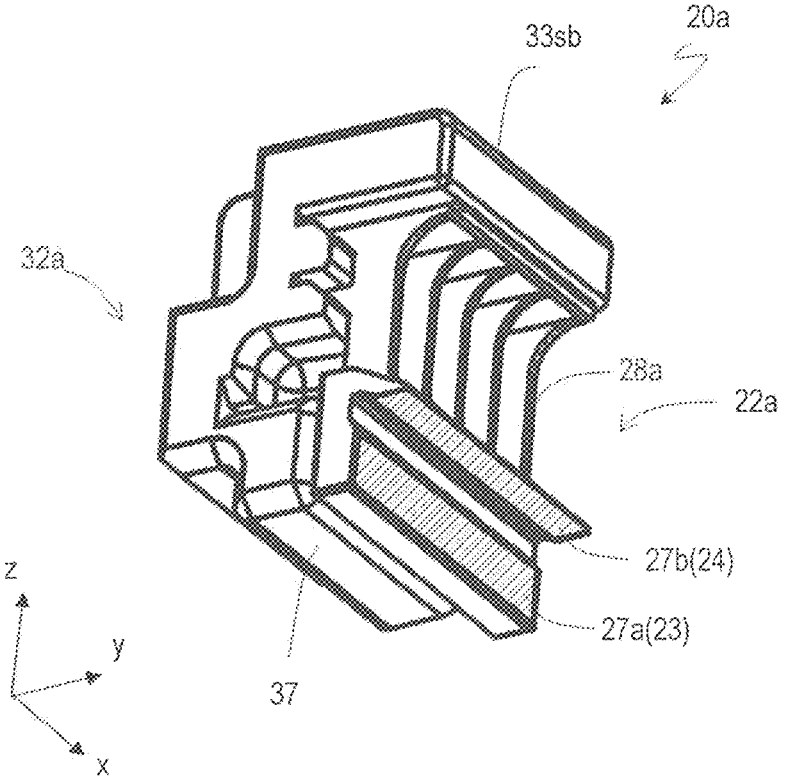

Now, with reference to FIG. 4(*a*) through FIG. 4(*d*), FIG. 5(*a*) and FIG. 5(*b*), an example of the inner member 22*a* and the outer member 32*a* will be described in detail. FIG. 4(*a*) is a schematic perspective view of the inner member 22*a*. FIG. 4(*b*) is a schematic plan view of the inner member 22*a* as seen in the z direction. FIG. 4(*c*) is a schematic; plan view of the inner member 22*a* as seen the −x direction. FIG. 4(*d*) is a schematic plan view of the inner member 22*a* as seen the x direction. FIG. 5(*a*) is a schematic perspective view of the outer member 32*a*. FIG. 5(*b*) is a schematic perspective view of the protection member 20*a* in a state where the inner member 22*a* is fit to the outer member 32*a*.

As shown in FIG. 4(*a*), the inner member 22*a* includes a receiving portion 22R having receiving surfaces 23 and 24, and a support portion 22S formed adjacent to the receiving portion 22R in the y direction and having a support surface 22Sa parallel to the xz plane. The support portion 22S includes a plurality of ribs 25*a*, 25*b* and 25*c* parallel to the xz plane. The support portion 22S also includes a plurality of (five in this example) ribs 28*a* parallel to the xy plane. The ribs 28*a* reinforce the support portion 22S and support the receiving surface 24. Therefore, the receiving surface 24 is not easily warped (elastically deformed) even if being supplied with an acceleration (force) in the y direction. Optional protection sheets 27*a* and 27*b* are respectively provided on the receiving surfaces 23 and 24. The protection sheets 27*a* and 27*b* may be omitted.

As shown in FIG. 5(*a*), the outer member 32*a* includes a plurality of grooves 35*a*, 35*b* and 35*c* parallel to the xz plane. The ribs 25*a*, 25*b* and 25*c* of the inner member 22*a* are respectively inserted into the grooves 35*a*, 35*b* and 35*c* of the outer member 32*a*, and as a result, the inner member 22*a* and the outer member 32*a* are fit to each other. In a state where the inner member 22*a* and the outer member 32*a* are fit to each other, the support surface 22Sa of the inner member 22*a* is in contact with a side surface 33*sa*, of the outer member 32*a*, parallel to the xz plane (see FIG. 5(*b*)). In addition, a rear surface of the receiving portion 22R (surface opposite to the receiving surface 23) of the inner member 22*a* is in contact with a portion 37 of the outer member 32*a*.

A bottom surface 22Rb, of the receiving portion 22R, parallel to the xy plane is in contact with the bottom surface member 12. By contrast, a bottom surface 22Sb, of the support portion 22S, facing the bottom surface member 12 and parallel to the xy plane is not in contact with the bottom surface member 12. Namely, length Z1 of the receiving portion 22R in the z direction is longer than length 22 of the support portion 22S in the z direction, and only the bottom surface 22Rb of the receiving portion 22R is in contact with the bottom surface member 12.

As shown in FIG. 4(*b*), the inner member 22*a* is structured such that the center of gravity thereof is present outer to the bottom surface 22Rb of the receiving portion 22R as seen in the z direction. The center of gravity, as seen in the z direction, of the inner member 22*a* may be shifted from the bottom surface 22Rb of the receiving portion 22R in the −x direction, in the y direction, or both of the −x direction and the y direction. Since the center of gravity of the inner member 22*a* is shifted from the bottom surface 22Rb of the receiving portion 22R as described above, the inner member 22*b* cannot stand itself on the bottom surface member 12 and falls in a direction in which the center of gravity thereof is shifted.

The position of the center of gravity of the inner member 22*a* may be adjusted by, for example, the shape of the support portion 22S. For example, the rib 25*a* may be protruded to be inserted deep into the groove 35*a* of the outer member 32*a*, so that the center of gravity of the inner member 22*a* is shifted in the −x direction.

The structure to cause the inner member 22*a* to fall in the −x direction or in the y direction may be modified in any of various manners. For example, a protrusion may be provided on the bottom surface 22Rb of the receiving portion 22R. Even with the structure in which the protrusion is provided on the bottom surface 22Rb, the receiving surfaces 23 and 24 may be located to be parallel to the z direction in a state where the inner member 22*a* is fit to the outer member 32*a*.

Ribs 26*a* are provided on the rear surface of the receiving portion 22R of the inner member 22*a* (provided on the surface opposite to the receiving surface 23, i.e., surface in contact with the outer member 32*a*). Therefore, the receiving surface 23 is not easily warped (elastically deformed) even if being supplied with an acceleration (force) in the −x direction. The ribs 26*a* shown in this example include two ribs extending parallel to the z direction and one rib extending parallel to the y direction so as to cross-centers of these two ribs. The ribs are not limited to having such a structure, and may include, for example, two or more ribs extending parallel to the y direction. The receiving portion 22R including the ribs 26*a* have a thickness (length in the x direction) of, for example, about 10 mm. The receiving surface 24 is supported by the support portion 22S, and therefore, is not easily warped (elastically deformed) even if being supplied with an acceleration (force) in the y direction.

As shown in FIG. 5(*a*), the outer member 32*a* has the side surface 33*sb* parallel to the xz plane and the side surface 34*s* parallel to the yz plane. The outer member 32*a* is located such that the side surface 33*sb* and the side surface 34*s* are respectively in contact, with the side surfaces, of the cutout portion 15*a* of the side surface member 14, that are parallel to the xz plane and the yz plane, and such that the bottom surface of the outer member 32*a* parallel to the xy plane is in contact with the bottom surface member 12. A portion 33 of the outer member 32*a* is located between the inner member 22*a* and the side surface member 14*a*, and a portion 34 of the outer member 32*a* is located between the inner member 22*a* and the side surface member 14*b* (see, for example, FIG. 2(*a*)). The outer member 32*a* supports the receiving surfaces 23 and 24 of the inner member 22*a* such that the receiving surfaces 23 and 24 are parallel to the z direction, and decreases the impact applied from the inner member 22*a* to the side surface member 14. The outer member 32*a* does not need to have the bottom surface parallel to the xy plane. A reason for this is that the outer member 32*a* is in contact, with the side surfaces, of the cutout portion 15*a* of the side surface member 14, that are parallel to the xz plane and the yz plane and thus is located such that the side surface 33*sb* and the side surface 34*s* are parallel to the z direction.

The outer member 32*a* further includes recessed portions 38*a* and 38*b*. The recessed portions 38*a* and 38*b* are provided such that in a state where the outer member 32*a* is located in the cutout portion 15*a*, hollows are formed between the outer member 32*a* and the side surface member 14. For detaching the outer member 32*a* located in the cutout portion 15*a*, fingertips may be inserted into the hollows formed between the outer member 32*a* and the side surface member 14. Thus, the outer member 32*a* may foe nipped easily with the fingers.

As represented by the dashed line in, for example, FIG. 4(*c*) and FIG. 4(*d*), the inner member 22*a* has a plane of symmetry SP parallel to the xy plane. Similarly, the outer member 32*a* has a plane of symmetry parallel to the xy plane. With such a structure, common inner members 22*a* and common outer members 32*a* may be used to form the four protection members 20*a*, 20*b*, 20*c* and 20*d*.

As described above, the container 100 according to an embodiment of the present invention includes the protection members 20*a*, 20*b*, 20*c* and 20*d*, and therefore, suppresses the breakage and the decrease in the working efficiency during the removal of the object accommodated in the container 100 (solves problem 1).

The container 100 according to an embodiment of the present invention includes the protection members 20*a*, 20*b*, 20*c* and 20*d*, and therefore, suppresses the accommodated object from being cracked or chipped away at a corner thereof when a large acceleration is applied to the accommodated object (solves problem 2). Now, this will be described.

Figure 6:
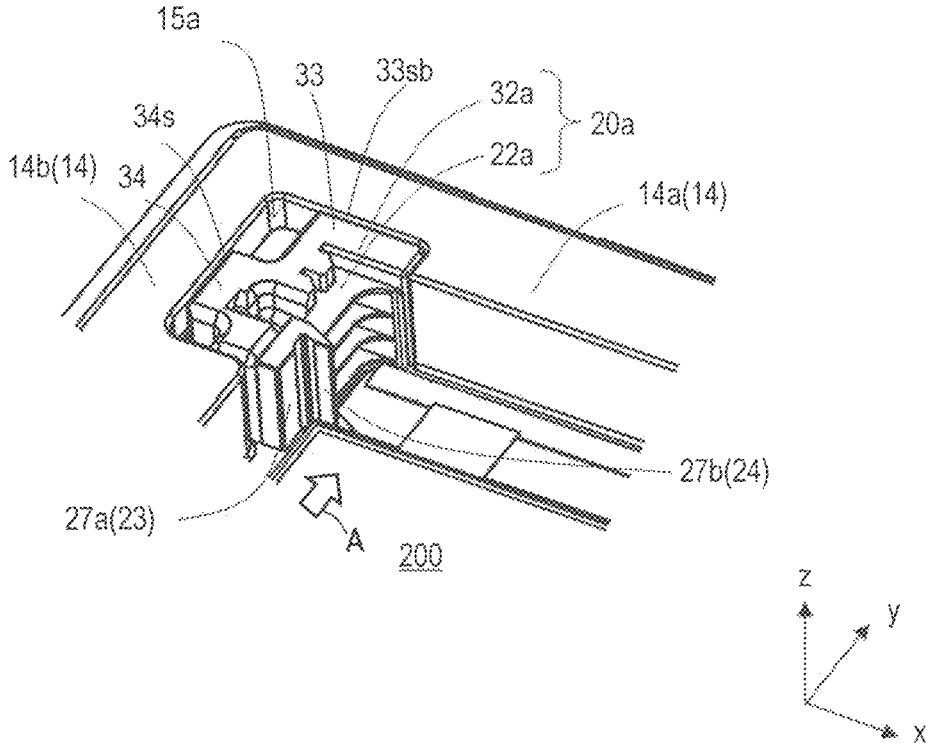
FIG. 6 is a schematic perspective view showing a state of the protection member 20*a* attached to the cutout portion 15*a*.

With reference to FIG. 4(*a*), FIG. 4(*b*), FIG. 5(*a*), FIG. 5(*b*) and FIG. 6, a structure of a portion at which the protection member 20*a* is in contact with the side surface member 14 will be described. FIG. 6 is a schematic perspective view showing a state of the protection member 20*a* attached to the cutout portion 15*a*.

As shown in FIG. 4(*a*) and FIG. 4(*b*), the inner member 22*a* includes the receiving portion 22R and the support portion 22S formed adjacent to the receiving portion 22R in the y direction. The receiving portion 22R has the receiving surface 23 parallel to the yz plane and the receiving surface 24 parallel to the xz plane. The support portion 22S has the support surface 22Sa parallel to the xz plane. The support surface 22Sa protrudes in the x direction more than the receiving surface 24 parallel to the xz plane.

The inner member 22*a* and the outer member 32*a* are fit to each other. In a state where the inner member 22*a* and the outer member 32*a* are fit to each other, the support surface 22Sa of the inner member 22*a* is entirety in contact with the side surface 33*sa*, of the outer member 32*a*, parallel to the xz plane (see FIG. 5(*b*)).

As shown in FIG. 6, the outer member 32*a* is located such that the side surface 33*sb* and the side surface 34*s* are respectively in contact with the side surfaces, of the cutout portion 15*a* of the side surface member 14, that are parallel to the xz plane and the yz plane. The portion 33 of the outer member 32*a* is located between the inner member 22*a* and the side surface member 14*a*, whereas the portion 34 of the outer member 32*a* is located between the inner member 22*a* and the side surface member 14*b*. The outer member 32*a* supports the receiving surfaces 23 and 24 of the inner member 22*a* such that the receiving surfaces 23 and 24 are parallel to the z direction, and decreases the impact applied from the inner member 22*a* to the side surface member 14.

The support surface 22Sa of the inner member 22*a* and the side surface 33*sb* of the outer member 32*a* protrude in the x direction more than the receiving surface 24 parallel to the xz plane. Therefore, even if an acceleration is applied to the panel module 200 in the y direction as represented by arrow A and as a result, a force acts on the protection member 20*a* so as to rotate the protection member 20*a* counterclockwise, the side surface 33*sb* of the outer member 32*a* receives a reaction from the side surface member 14, and as a result, the protection member 20*a* does not rotate.

As described above with reference to FIG. 9, in the protection member 92*a* included in the container 900 in the comparative example, the receiving surface RS2 protrudes in the x direction more than the support surface SS2. Therefore, the moment of force acting on the receiving surface RS2 so as to rotate the protection member 32*a* counterclockwise is large. Therefore, the reaction received by the support surface SS2 from the side surface member 94*a* cannot suppress the rotation of the protection member 92*a*.

Similarly, the protection member 92*a* has a problem of rotating clockwise when being supplied with an acceleration in the −x direction. A reason for this is that the receiving surface RS1 protrudes in a −y direction more than the support surface SS1. By contrast, as shown in FIG. 6, the receiving surface 23 of the protection member 20*a* is supported by the portion 34, of the outer member 32*a*, located between the inner member 22*a* and the side surface member 14*b*. Therefore, the protection member 20*a* is suppressed from rotating even if being supplied with an acceleration in the −x direction.

Figure 7:
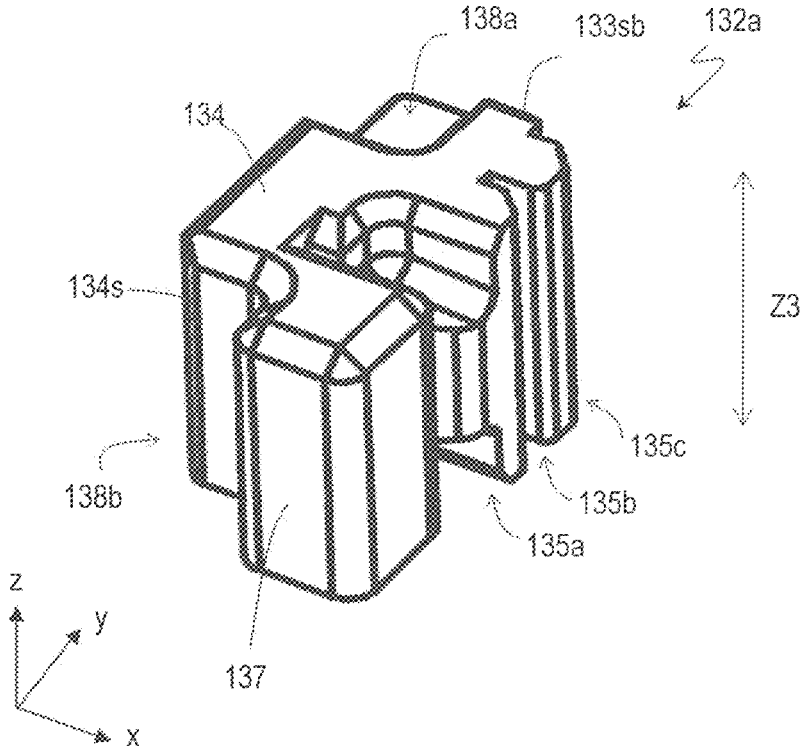
FIG. 7 provides schematic views provided to describe a protection member 120*a* usable in a container according to another embodiment of the present invention.
Figure 7:
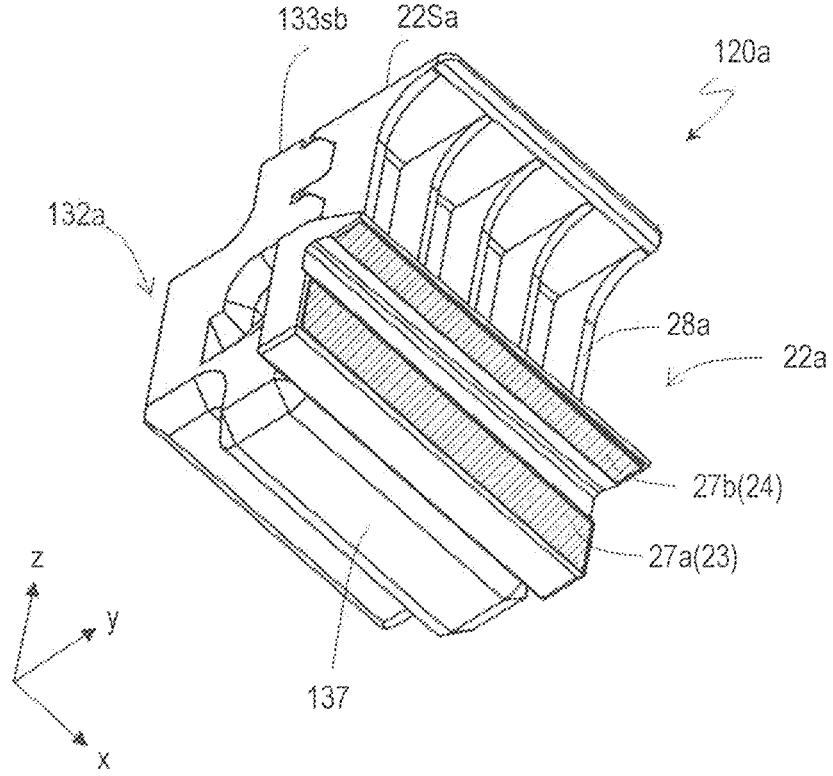
Figure 8:
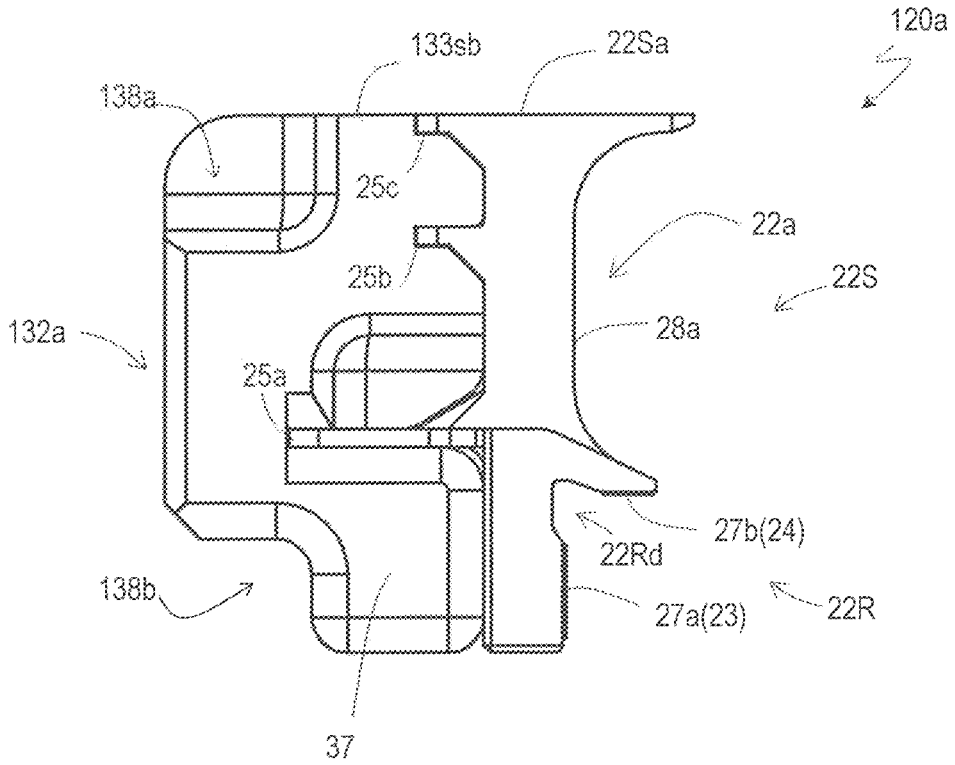
FIG. 8 is a schematic plan view of the protection member 120*a*.

With reference no FIG. 7(*a*), FIG. 7(*b*) and FIG. 8, a protection member 120*a* usable in a container according to another embodiment of the present invention will be described. FIG. 7(*a*) is a schematic perspective view of an outer member 132*a* included in the protection member 120*a*. FIG. 7(*b*) is a schematic perspective view of the protection member 120*a* in a state where the inner member 22*a* is fit to the outer member 132*a*. FIG. 8 is a schematic plan view of the protection member 120*a*.

The protection member 120*a* includes the outer member 132*a* and the inner member 22*a*. Namely, unlike the outer member 32*a* described above, the outer member 132*a* of the protection member 120*a* does not include the portion 33 located between the inner member 22*a* and the side surface member 14*a*. Except for this, the structure of the outer member 132*a* is the same as that of the outer member 32*a*. For reference signs representing components of the outer member 132*a*, "100" will be added to the reference signs representing the corresponding components of the outer member 32*a*.

As shown in FIG. 7(*a*), the outer member 132*a* has a side surface 133*sb* parallel to the xz plane, and a side surface 134*s* parallel to the yz plane. The outer member 132*a* is located such that the side surface 133*sb* and the side surface 134*s* are respectively in contact with side surfaces, of the cutout portion 15*a* of the side surface member 14, that are parallel to the xz plane and the yz plane, and such that a bottom surface of the outer member 132*a* parallel to the xy plane is in contact with the bottom surface member 12. A portion 134 of the outer member 132*a* is located between the inner member 22*a* and the side surface member 14*b*. The outer member 132*a* further includes recessed portions 138*a* and 138*b*. The recessed portions 138*a* and 138*b* are provided such that in a state where the outer member 132*a* is located in the cutout portion 15*a*, hollows are formed between the outer member 132*a* and the side surface member 14.

As shown in FIG. 7(*a*), the outer member 132*a* includes a plurality of grooves 135*a* and 135*b* and a cutout 135*c* parallel to the xz plane. As shown in FIG. 7(*b*) and FIG. 8, the ribs 25*a*, 25*b* and 25*c* of the inner member 22*a* are respectively inserted into the plurality of grooves 135*a* and 135*b* and the cutout 135*c* of the outer member 132*a*, and as a result, the inner member 22*a* and the outer member 132*a* are fit to each other. The rear surface of the receiving portion 22R (surface opposite to the receiving surface 23) of the inner member 22*a* is in contact with a portion 137 of the outer member 132*a*.

In a state where the inner member 22*a* and the outer member 132*a* are fit to each other, the support surface 22Sa of the inner member 22*a* is substantially flush with the side surface 133*sb*, of the outer member 132*a*, parallel to the xz plane. The expression that "the support surface 22Sa of the inner member 22*a* and the side surface 133*sb* of the outer member 132*a* are substantially flush with each other" indicates that the support surface 22Sa and the side surface 133*sb* are flush with each other to such a degree that the support surface 22Sa and the side surface 133*sb* may both be in contact with the side surface, of the side surface member 14, that is parallel to the xz plane. The protection member 120*a*, when being attached to the cutout portion 15*a*, is located such that the support surface 22Sa of the inner member 22*a* and the side surface 133*sb* of the outer member 132*a* are in contact with the side surface, of the side surface member 14, that is parallel to the xz plane. The support surface 22Sa of the inner member 22*a* protrudes in the x direction more than the receiving surface 24 parallel to the xz plane. Therefore, like in the case of the protection member 20*a* shown in FIG. 6, even if an acceleration is applied to the panel module 200 in the y direction, and as a result, a force acts on the protection member 120*a* so as to rotate the protection member 120*a* counterclockwise, the support surface 22Sa of the inner member 22*a* and the side surface 133*sb* of the outer member 132*a* receive a reaction from the side surface member 14, and as a result, the protection member 120*a* does not rotate.

It is preferred that length 23 of the outer member 132*a* in the z direction fulfills the relationship of $Z2 \leq Z3 \leq Z1$ where Z2 is the length of the support portion 22S in the z direction and Z1 is the length of the receiving portion 22R in the z direction. Now, it is assumed that, for example, the relationship $Z3=(Z1+Z2)/2$ is fulfilled. In this case, when the bottom surface (parallel to the xy plane) of the outer member 132*a* is in contact with the bottom surface member 12, a top surface of the outer member 132*a* and a top surface of the support portion 22S of the inner member 22*a* are flush with each other (see FIG. 7(*b*)) in a state where the bottom surface 22Rb (parallel to the xy plane) of the receiving portion 22R of the inner member 22*a* is in contact with the bottom surface member 12. With such sizes, it is easy to set the protection member 120*a* at a predetermined position, and it is also easy to confirm that the protection member 120*a* is set accurately at the predetermined position. This is also applicable to the outer member 32*a* (see FIG. 5(*a*)) described above.

Unlike in the protection member 20*a*, in the protection member 120*a*, the outer member 132*a* covers only one surface of the inner member 22*a* (covers only the surface directed toward the side surface member 14*b*). This provides an advantage that the outer member 132*a* is easily detachable. The structure of the outer member 132*a* is simpler than that of the outer member 32*a*, which provides an advantage that the outer member 132*a* is difficult to be broken and is easy to be produced.

Now, preferred materials for each of the components of the container 100 will be described. The materials described below are preferred examples of materials for the container 100 transporting the panel module 200, and the preferred materials are not limited to those described below.

The accommodation member 10 (bottom surface member 12 and side surface member 14), the outer members 32*a* and 132*a* and the inner members 22*a* may all be formed of a plastic material. A plastic material preferably usable for these components is any of various known plastic materials (thermoplastic resins). Examples of the usable plastic material include polyolefins such as polyethylene, polypropylene and the like, polystyrenes, and mixtures (blends) thereof. These plastic materials in an expanded form are also usable.

For the accommodation member 10, a material having a large effect of absorbing the impact during the transportation is preferred. The accommodation member 10 is preferably formed of an expanded plastic material. For the inner member 22*a*, which directly receives a force from the panel module 200 (panel 202), a material harder than the material of the outer members 32*a* and 132*a* and the material of the accommodation member 10 is preferred. The inner member 22*a* is preferably formed of a non-expanded plastic material. The protection sheets 27*a* and 27*b* are preferably formed of a non-expanded plastic material harder than the material of the inner member 22*a*. The outer members 32*a* and 132*a*, which are each located between the accommodation member 10 and the inner member 22*a*, are preferably formed of a material having a hardness between the hardness of the material of the accommodation member 10 and the hardness of the material of the inner member 22*a*, or a material having a hardness approximately equal to that of the material of the accommodation member 10, for example, an expanded plastic material.

For example, the inner member 22*a* is formed of, preferably, non-expanded polyethylene, and more preferably, high density polyethylene from the point of view of the hardness. The protection sheets 27*a* and 27*b* are in direct contact with, for example, a glass substrate of the panel module 200 (panel 202) and therefore, is preferably formed of polycarbonate, which is highly abrasion resistant.

The outer members 32*a* and 132*a* are preferably formed of, for example, expanded polyethylene (EPE) or expanded polypropylene (EPP). Alternatively, an expanded form of a mixture (blend) of polyethylene or polypropylene and polystyrene may be used for the outer members 32*a* and 132*a*. The expansion ratio of these expanded plastic materials is, for example, 10 to 20 times. For example, an expanded form of a mixture (blend) of polyethylene and polystyrene expanded at a ratio of 10 times is preferably usable for the outer members 32*a* and 132*a*.

The accommodation member 10 is preferably formed of expanded polyethylene (EPE), expanded polypropylene (EPP) or expanded polystyrene (EPS, also referred to as "styrofoam"). Among these materials, expanded polystyrene (EPS) is most preferable. It should be noted that in order to transport the panel module 200 more safely, it is especially preferred to use expanded polystyrene expanded at a ratio lower than that of commonly and widely used expanded polystyrene (expansion ratio: about 70 times), for example, expanded polystyrene expanded at a ratio of about 20 times to about 50 times.

The above-described materials have been selected based on results of an impact test. For the impact test, a state where 20 liquid crystal display panel modules (60-inch type) were accommodated in the container 100 produced with various materials was simulated. With the above-described materials, the liquid crystal display panel modules may be transported very safely. Namely, the liquid crystal display panel modules may be suppressed from being broken during the transportation. The 60-inch liquid crystal display panel modules used for the test had a size of about 1300 mm×about 800 mm. The container 100 had an outer shape of about 1500 mm to about 1600 mm×about 900 mm to about 1000 mm and a height of about 120 mm to about 150 mm. In order to increase the strength, the outer shape of the container 100 may be increased. In order to increase the transportation efficiency and decrease the cost, the outer shape of the container 100 may be decreased. The material of each of the components may be selected from the above-listed materials, and the size of each of the components may be optimized, in accordance with the use.

INDUSTRIAL APPLICABILITY

An embodiment of the present invention is directed to a container preferably usable to, for example, transport an object accommodated therein.

REFERENCE SIGNS LIST

10 accommodation member
10*s* accommodation space
12 bottom surface member
14, 14*a*, 14*b*, 14*c*, 14*d* side surface member
14*s* stepped portion
15*a*, 15*b*, 15*c*, 15*d* cutout portion
20*a*, 20*b*, 20*c*, 20*d* protection member
22R receiving portion
22Rb bottom surface
22S support portion
22Sa support surface
22Sb bottom surface
22*a* inner member
23, 24 receiving surface
25*a*, 25*b*, 25*c* rib
26*a*, 28*a* rib
32*a*, 132*a* outer member
35*a*, 35*b*, 35*c*, 135*a*, 135*b*, 135*c* groove
70 lid
100 container
200 liquid crystal display panel module
202 liquid crystal display panel
204 circuit board

The invention claimed is:

1. A container, comprising:

an accommodation member including a bottom surface member defining a bottom surface of an accommodation space having four corners and also including a side surface member defining side surfaces of the accommodation space, the bottom surface member defining an xy plane and the side surface member defining an xz plane and a yz plane both perpendicular to the xy plane; and two protection members each having two receiving surfaces that are to be in contact with an object to be accommodated in the accommodation space and are respectively parallel to the xz plane and the yz plane, wherein the side surface member includes two cutout portions respectively facing two corners adjacent to each other among the four corners of the accommodation space, wherein each of the two protection members includes an inner member including a receiving portion having the two receiving surfaces and also includes an outer member located at least between the inner member and a side surface, of the side surface member, that is parallel to the yz plane, the outer member being fit to the inner member so as to be skiable in a certain direction crossing the bottom surface, wherein the two protection members are respectively located in the two cutout portions in a state where the inner member and the outer member included in each of the two protection members are detachable in the certain direction independently, and wherein the inner member further includes a support portion formed adjacent to the receiving portion in a y direction and having a support surface parallel to the xz plane, and the support surface protrudes in an x direction more than the receiving surface parallel to the xz plane.

2. The container of claim 1, wherein the support surface of the inner member is contactable with a side surface, of the side surface member, that is parallel to the xz plane.

3. The container of claim 1, wherein the support surface of the inner member and a side surface, of the outer member, that is parallel to the xz plane are substantially flush with each other.

4. The container of claim 1, wherein the outer member is also located between the support surface and a side surface, of the side surface member, that is parallel to the xz plane.

5. The container of claim 1, wherein when the outer member is detached, the inner member falls toward a space where the outer member was present before being detached.

6. The container of claim 1, wherein the outer member is fit to the inner member so as to be slidable in a z direction.

7. The container of claim 6, wherein the inner member includes a plurality of ribs parallel to the xz plane, and the outer member includes a plurality of grooves parallel to the xz plane.

8. The container of claim 1, wherein the receiving portion of the inner member has a bottom surface in contact with the bottom surface member and parallel to the xy plane, and wherein a bottom surface, of the support portion, facing the bottom surface member and parallel to the xy plane is not in contact with the bottom surface member.

9. The container of claim 1, wherein a length of the receiving portion in a z direction is longer than a length of the support portion in the z direction.

10. The container of claim 1, wherein the center of gravity of the inner member is present outer to the bottom surface of the receiving portion as seen in a z direction.

11. The container of claim 1, wherein the inner member is formed of a non-expanded plastic material, and the outer member is formed of an expanded plastic material.

12. The container of claim 11, further comprising a protection sheet provided on each of the two receiving surfaces of the inner member, and the protection sheet is formed of a non-expanded plastic material harder than the material of the inner member.

13. The container of claim 11, wherein the accommodation member is formed of an expanded plastic material having a hardness equal to that of the expanded plastic material of the outer member or an expanded plastic material softer than the expanded plastic material of the outer member.

14. The container of claim 1, wherein the inner member and the outer member each have a plane of symmetry parallel to the xy plane.

* * * * *